US007353621B2

(12) United States Patent
Clarke et al.

(10) Patent No.: US 7,353,621 B2
(45) Date of Patent: Apr. 8, 2008

(54) CLEANING APPARATUS FOR VERTICAL SEPARATOR

(75) Inventors: Tony Clarke, Katy, TX (US); Richard Bingham, Katy, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 11/359,101

(22) Filed: Feb. 22, 2006

(65) Prior Publication Data

US 2007/0193055 A1 Aug. 23, 2007

(51) Int. Cl.
*F26B 11/02* (2006.01)

(52) U.S. Cl. ..... 34/138

(58) Field of Classification Search ..... 34/138, 34/58, 90, 92, 380, 381; 15/316.1; 134/21; 209/391

See application file for complete search history.

(56) References Cited

U.S. PATENT DOCUMENTS

| | | | | |
|---|---|---|---|---|
| 3,897,836 | A * | 8/1975 | Hall et al. | 175/93 |
| 4,061,485 | A * | 12/1977 | Rimmel | 65/377 |
| 5,256,289 | A | 10/1993 | Cope et al. | |
| 5,410,795 | A | 5/1995 | Derton et al. | |
| 6,013,158 | A * | 1/2000 | Wootten | 202/99 |
| 6,368,512 | B1 | 4/2002 | Wirz et al. | |

* cited by examiner

*Primary Examiner*—S. Gravini

(57) ABSTRACT

A cleaning apparatus for a material dryer may include an air source, a pulse nozzle selectively in fluid communication with the air source and located within a section of the solids outlet assembly, and a controller for controlling an air flow from the air source periodically to the pulse nozzle, where the nozzle is actuated by the periodic air flow to provide a corresponding periodic burst of air to the section of the solids outlet assembly, and the burst of air is of sufficient force to dislodge material accumulated within the section.

17 Claims, 2 Drawing Sheets

CLEANING APPARATUS FOR VERTICAL SEPARATOR

BACKGROUND OF INVENTION

Rotary drilling methods employing a drill bit and drill stems have long been used to drill wellbores in subterranean formations. Drilling fluids or muds are commonly circulated in the well during such drilling to cool and lubricate the drilling apparatus, lift drilling cuttings out of the wellbore, and counterbalance the subterranean formation pressure encountered. The recirculation of the drilling mud requires the fast and efficient removal of the drilling cuttings and other entrained solids from the drilling mud prior to reuse. Shaker separators are commonly used to remove the bulk solids from the drilling fluid.

The bulk solids removed from the drilling fluid by shaker separators often include hydrocarbons, either from the drilling fluid, the wellbore, or both. Such oily cuttings typically cannot be discharged into the environment directly from the shaker due to the negative impact of the hydrocarbon material on the environment, as well as the value associated with the drilling fluid. Further, cuttings that are oil wet or water wet are often difficult to handle. Thus, a drying operation for drill cuttings is often implemented as a secondary operation to the shaker separator to remove residual drilling fluid from the cuttings.

Vertical, centrifugal separators are often used to dry the cuttings before discharge or collection. In general, vertical separators, or material dryers, include a housing containing a drive mechanism to which is connected both a flight assembly and a screen assembly. The separator further includes an inlet for induction of the material to be separated. Material directed into the separator is captured by the flight and screen assemblies, separation occurring as the material migrates downwardly with a liquid component and/or very small particles being forced outwardly through a fine mesh screen into a space between the screen and the housing by centrifugal force. The majority of the liquids are then drawn off and the solids are generally ejected from an outlet assembly located below the rotor drive assembly. Material that is discharged from the separator exits through a solids outlet assembly portion of the separator. Due to the centrifugal force used to remove the liquid component of the material, during discharge the solid component tends to be flung outward and in the direction of rotation of the flight and screen assemblies. This often causes an accumulation of solid material in the solid outlet assembly which must periodically be removed to avoid backup of material propagating from the outlet assembly into the area between the flight and screen assemblies. To clean the solids outlet assembly requires stopping operation of the separator for the time required to clean out the assembly. It would therefore be an improvement to have an automatic cleaning apparatus that could clean and maintain the outlet assembly during normal operation of the separator. An additional advantage of such a system would be an improvement in the efficiency of the separator to treat material by increasing the effective online production time as well as maintaining a sufficient opening for solids to be discharged out of the separator before material back-up can diminish the separating efficiency of the flight and screen assembly.

SUMMARY

In one aspect, the present invention relates to an apparatus for drying material. The apparatus may include an outer housing having a top portion with a material inlet, a drive assembly including a rotatable drive shaft within the outer housing, a flight assembly coupled to the drive shaft and rotatably driven by the driveshaft, and a screen assembly coupled to the drive assembly where the screen assembly is rotatably driven by the drive assembly. The screen assembly may include a perforated screen located radially outwardly from the flight assembly, the screen assembly and the flight assembly rotating at different speeds. Material fed through the material inlet is centrifugally directed between the flight assembly and the screen assembly where the screen assembly separates a fluid component of the material from a solid component. The apparatus may also include a solids outlet assembly coupled to the outer housing and positioned below the screen assembly and flight assembly, where the solids outlet includes a circumferential outer wall, a center hub, and a plurality of spokes extending between the central hub and the outer wall to define a plurality of sections through which solid material is discharged. The apparatus also includes a cleaning apparatus coupled to the solids outlet assembly, where the cleaning apparatus may include a plurality of pulse nozzles coupled to the solids outlet assembly, an air source selectively in fluid communication with each pulse nozzle, and a controller for controlling a flow of air from the air source periodically to the plurality of nozzles. Each nozzle is actuated by the periodic flow of air to provide a corresponding periodic burst of air to each section defined in the solids outlet assembly, the burst of air being of sufficient force to dislodge material accumulated in the solids outlet.

In another aspect of the invention, a cleaning apparatus for a material dryer may include an air source, a pulse nozzle selectively in fluid communication with the air source and located within a section of the solids outlet assembly, and a controller for controlling an air flow from the air source periodically to the pulse nozzle, where the nozzle is actuated by the periodic air flow to provide a corresponding periodic burst of air to the section of the solids outlet assembly, and the burst of air is of sufficient force to dislodge material accumulated within the section.

In yet another aspect, the present invention relates to a method of cleaning a solids outlet assembly of a material dryer. The method may include the steps of periodically actuating a plurality of pulse nozzles coupled to the solids outlet assembly of an outer housing of the material dryer to loosen material accumulated on the solids outlet assembly and discharging the loosened material.

Other aspects and advantages of the claimed subject matter will be apparent from the following description and the appended claims.

BRIEF DESCRIPTION OF THE DRAWINGS

For a further understanding of the nature and objects of the present invention, reference should be made to the following detailed description taken in conjunction with the accompanying drawings, in which like parts are given the same reference numerals, and wherein.

DETAILED DESCRIPTION

In one aspect embodiments disclosed herein are directed to an apparatus and method for efficiently drying material such as drill cuttings. In another aspect, embodiments disclosed herein are directed to an apparatus and method of automatically cleaning a material dryer during operation of the material dryer.

Figure 1:
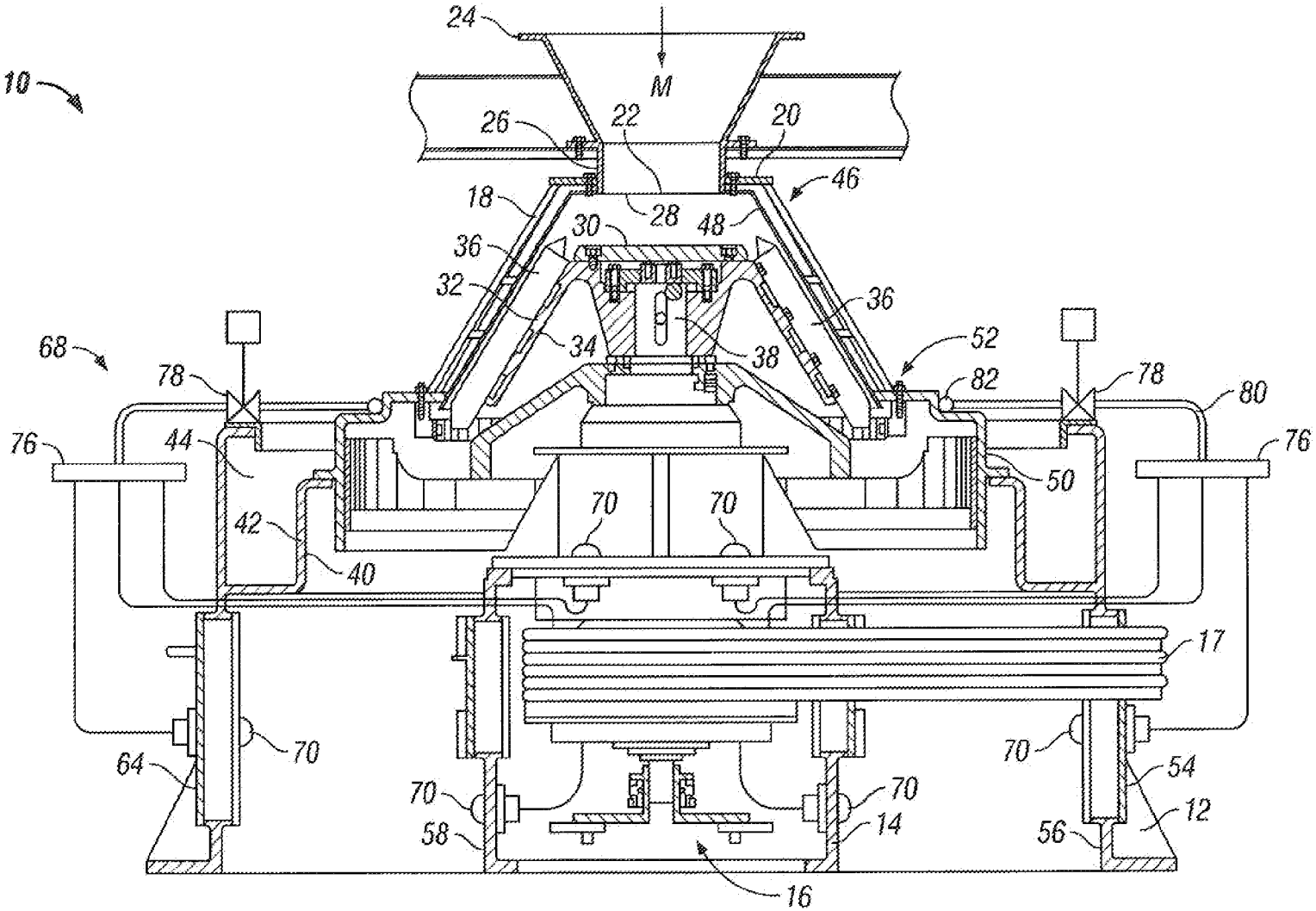
FIG. 1 is a cross-sectional, front elevation of a material dryer employing the cleaning apparatus of the present invention.

Referring to FIG. 1, a centrifugal separator, or material dryer, of the present invention is shown generally as 10. The terms "centrifugal separator" and "material dryer" are used herein, interchangeably, to refer to an apparatus that imparts centrifugal force to a wet material to separate liquid and solid components of the material, thereby drying the solid component. Heat may be, but need not be, applied to the process. The separator 10 includes a main base 12 having a drive housing 14 therein. Drive housing 14 covers a conventional belt or other drive assembly, shown generally at 16.

Separator 10 also includes a frusto-conical outer housing 18 having a top plate 20. In one embodiment, the top plate 20 has an opening 22 in which is fitted an inlet assembly 24 though which material M to be separated is fed into the separator 10. In one embodiment, the inlet 24 has a vertical spout 26 extending down inside the housing 18.

Positioned beneath an outlet 28 of the spout is a plate 30 which is rotated via the drive assembly 16. Material falling through the inlet 24 strikes the rotating plate 30 and is thrown off by a centrifugal force. A flight assembly 32 comprises a hollow frustrum of a right circular cone 34. A plurality of flights 36 are attached to the outer surface of the cone 34 and extend around the cone 34. In one embodiment, the flights 36 are attached to the outer surface of the cone 34 and extend around the cone 34 in a vertical, spiraling fashion. The flight assembly 32 is mounted within housing 18 and is attached to a drive shaft 38 of drive assembly 16. The flight assembly 32 is therefore rotatably driven by the drive assembly 16. Plate 30 is attached to the upper end of supporting cone 34. At the base of housing 18, a baffle assembly 40 includes a circumferential baffle 42 which is spaced inwardly from the side wall of the housing so a circumferential opening 44 is formed there between.

A screen assembly 46 comprises a perforated screen 48 attached to a rotor 50. The screen assembly 46 is connected to the rotor 50. In one embodiment, the rotor 50 is attached to a lower end of the screen assembly 46. The rotor 50 is connected to the drive assembly 16, as indicated at 52, for the screen assembly 46 to be rotated by the drive assembly 16. The rotor 50 includes a plurality of vanes or spokes (not shown) radially extending from an inner hub to an outer wall 56. Because the vanes are circumferentially spaced about the rotor, arcuate openings are formed therebetween. Solid material that is too large to pass through the screen 48 is discharged through the openings in the rotor 50.

Figure 3:
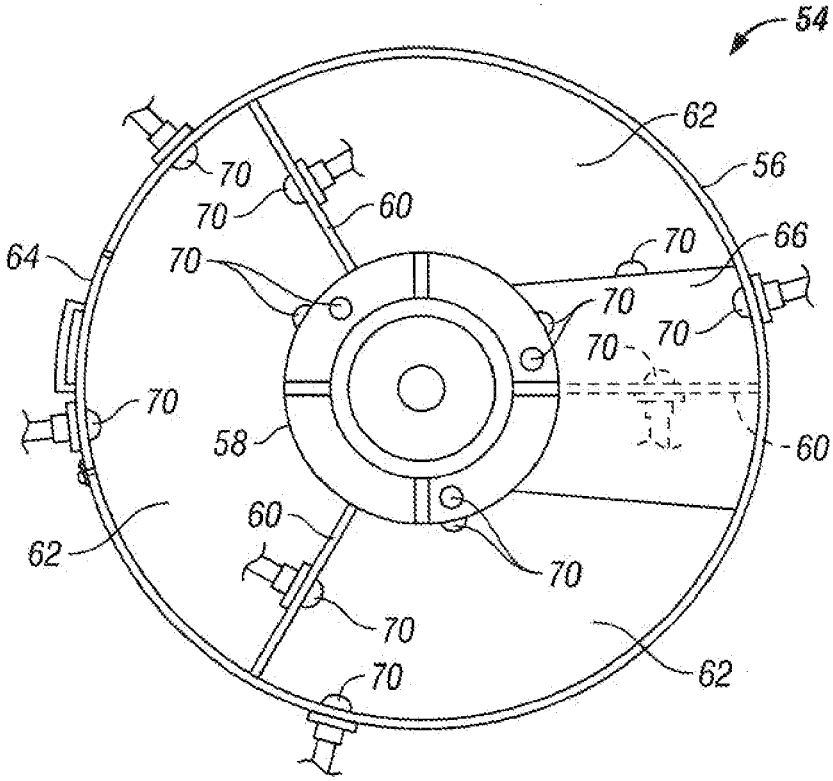
FIG. 3 is a cross-sectional, top elevation of a solids outlet assembly employing the cleaning apparatus of the present invention.

Below the rotor 50, the main base 12 of the outer housing 18 defines a solids outlet assembly 54. Referring to FIG. 3, the solids outlet assembly 54 includes a circumferential outer wall 56 within which is a concentric center hub 58. A plurality of spokes 60 extend between the center hub 58 and the outer wall 56 to define a plurality of discharge sections 62 through which solid material is discharged. The term "discharge section" is also known as "operating cell" and the terms may be used interchangeably. In one embodiment, the outer wall 56 has an inspection door 64 therethrough to provide access to the inside of the separator 10 and, particularly, to the inside of the solids outlet assembly 54. The solids outlet assembly 54 depicted in FIG. 3 is shown as having three spokes 60 defining three discharge sections 62. It is appreciated that additional spokes 60 can be included between the center hub 58 and the outer wall 56 to define additional discharge sections 62 without departing from the scope of this invention. In one embodiment, the solids outlet assembly 54 also encompasses a portion of the drive assembly 16. In this embodiment, a shield 66 covers the drive belt 17 (shown on FIG. 1) between the outer wall 56 and the hub 58 to protect the belt 17 from solid material being discharged through the solids outlet assembly 54. Solids that are discharged through the solids outlet assembly 54 tend to accumulate on the spokes 60 and outer wall 56 due to the centrifugal forces imparted to them by the flight assembly 32 and screen assembly 46. Solid material also accumulates on the center hub 58.

Figure 2:
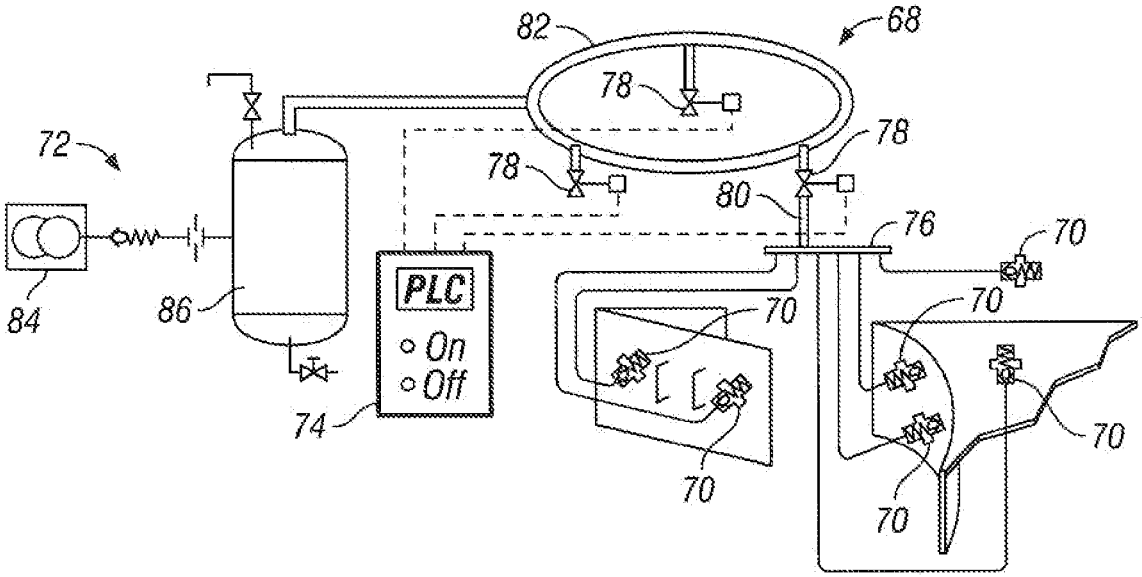
FIG. 2 is a schematic view of the cleaning apparatus of the present invention.

Referring also to FIG. 2, a cleaning apparatus 68 includes a plurality of pulse nozzles 70 coupled to the solids outlet assembly 54 and in fluid communication with an air source 72. A controller 74 controls the flow of air from the air source 72 to each pulse nozzle 70. Each pulse nozzle 70 is actuated such that a short burst of air is discharged from the nozzle. In one embodiment, each pulse nozzle 70 is actuated by the periodic flow of air to provide a corresponding periodic burst of air to each discharge section 62 of the solids outlet assembly 54. When the pulse nozzle 70 is actuated, as will be described below, the burst of air removes accumulated material around the nozzle 70. In one embodiment, a pulse nozzle 70 is coupled to each spoke 60 in a location where solid material accumulates during operation of the separator 10. In this embodiment, each pulse nozzle 70 is positioned to direct air into the corresponding discharge section 62. In one embodiment, a plurality of pulse nozzles 70 are coupled to the solids outlet assembly 54 in various locations within each discharge section 62 of the solids outlet assembly 54. In one embodiment, a pulse nozzle 70 is located on the outer wall 56, spoke 60, and center hub 58 of each discharge section 62 to direct material toward the center of the discharge section 62. In one embodiment, at least one pulse nozzle 70 is located on the inspection door 64. In one embodiment, at least one pulse nozzle 70 is located on a portion of the shield 66 over the drive assembly 16.

Positioning of the pulse nozzles 70 relative to the surface face of the assembly to be cleaned is managed to effect the desired cleaning action. A radial air discharge provides surface wall cleaning and is associated with an extended nozzle tip position. Axial discharge is realized with a surface flush nozzle tip position. Both of these positions are utilized to achieve the correct material movement and air blast relative to the nozzle's location within the outlet assembly.

In one embodiment, a nozzle manifold 76 is selectively in fluid communication with the air source 72 and in fluid communication with a plurality of pulse nozzles 70. The nozzle manifold 76 distributes air to each of the pulse nozzles 70 with which it is in fluid communication. In one embodiment a nozzle manifold 76 distributes air to a plurality of pulse nozzles 70 in a corresponding discharge section 62 of the solids outlet assembly 54. In this embodiment, a separate nozzle manifold 76 is present for each discharge section 62.

In one embodiment, a valve 78 is used to communicate air from the air source to at least one pulse nozzle 70. The controller 74 transmits a signal to actuate the valve 78. When the valve 78 is actuated, communication of air from the air source 72 is transmitted through an air line 80 to at least one pulse nozzle 70. As is described below, the controller 74 may be programmed to selectively actuate the valve 78 so that the valve 78 selectively communicates air to actuate a pulse nozzle 70. In one embodiment, a valve 78 communicates air from the air source 72 to a nozzle manifold 76 when actuated. In this embodiment, the valve 78 communicates air from the air source 72 to a plurality of pulse nozzles 70 through a corresponding valve manifold 82. In one embodiment, a valve 78 communicates air from the air source 72 to a plurality of pulse nozzles 70 positioned within a discharge section 62 of the solids outlet assembly 54. In this embodiment, a plurality of valves 78 selectively communicate air from the air source 72 to a nozzle manifold 76 corresponding to the pulse nozzles 70 in a discharge section 62 of the solids outlet assembly 54.

In one embodiment, a valve manifold 82 distributes air from the air source 72 to a plurality of valves 78. The valve manifold 82 is in fluid communication with the air source 72 and each valve 78. In this embodiment, a single air source 72 can provide air to each valve 78 in the cleaning apparatus 68. In one embodiment, shown in FIGS. 1 and 2, the valve manifold 82 has a shape adapted to rest on the outside of the outer housing 18. In one embodiment, the shape of the valve manifold 82 is circular, however it will be appreciated that the valve manifold 82 may be of any convenient shape without departing from the scope of this invention.

In one embodiment, the air source 72 is rig air. In this embodiment, air is communicated through air lines from an existing rig air source to the cleaning apparatus 68. In another embodiment, shown in FIG. 2, the air source 72 is a dedicated compressor 84. The air source 72 provides air at sufficient pressure and volume flow rates to actuate a predetermined number of pulse nozzles 70. Further, the air pressure and volume flow rate provided must be sufficient to actuate a predetermined number of pulse nozzles 70 and blow away accumulated material in the area around each pulse nozzle 70. To provide sufficient air pressure and volume flow rate, an accumulator 86 may be located in fluid communication with the air source 72. The accumulator 86 enables actuation of the pulse nozzles 70 when the air source 72 is unable to provide sufficient air volume to actuate the pulse nozzles 70 and to remove accumulated solids from the area around the each pulse nozzle 70. This depletion of the air source is a function of the pre-selected cycle profile and frequency of pulse selected by the controller 74. With knowledge of the total available air volume source 72, the controller will impose maximum limits to avoid system air starvation. In one embodiment, the accumulator 86 is in fluid communication with the air source 72 and the valve manifold 82.

The controller 74 is used to selectively actuate one or more pulse nozzles 70. In one embodiment, the controller 74 is a programmable logic controller. In one embodiment, the controller is a PC. In one embodiment, the controller 74 actuates a valve 78 to selectively communicate air to actuate one or more pulse nozzles 70. In one embodiment, the controller 74 is programmed to actuate a valve 78 for a predetermined amount of time and then de-actuate the valve 78. In this embodiment, the actuated valve 78 remains open and communicating air sufficient to actuate corresponding pulse nozzles 70 and remove accumulated material for a predetermined amount of time. The amount of time during which the valve 78 remains actuated corresponds to an amount of time sufficient to actuate the corresponding pulse nozzles 70 and remove material from the area around each pulse nozzle 70. In one embodiment, relatively short bursts of air are used to "knock" material from the walls around each pulse nozzle 70. Such bursts may be in the range of 0.5 to 5 seconds. In one embodiment, longer air flows are used to remove accumulated material. It should be noted, however, that when a compressor 84 and accumulator 86 are utilized, each burst or air flow depletes air in the accumulator 86. The period of time, therefore, that a valve 78 is to be actuated, the time between actuations, and the sizing of the accumulator 86 are all related and must all be taken into account when determining the predetermined time for a valve 78 to be actuated.

In one embodiment, the controller 74 actuates a plurality of valves 78 in sequence. In this embodiment, only one valve 78 is actuated at a time, In one embodiment, each valve 76 is actuated repeatedly for a predetermined number of times before the next valve 78 in sequence is actuated the predetermined number of times. In this embodiment, the predetermined number of times that a valve 78 is actuated is the number of times that is shown to effectively remove accumulated material from the walls 56, 58 of the corresponding discharge section 62. The number of actuations will vary with different materials and fluids. The system Operator will select the desired "on" actuation period and "off" actuation period for each pulse nozzle 70 operation. Likewise the Operator will identify the total supply volume flow rate and pressure of air into the system. The total number of discharge sections 62, or operating cells, and number of nozzles 70 per cell will also be inputted into the PLC. In one embodiment, a final selection will be made by the Operator, identifying the type of formation to be drilled from a selection menu (sand stone, siltatone, clays, shales) The PLC logic will then determine the minimum total system frequency period that can be exercised without depleting the air system. The actual frequency of pulse will be a function of minimum allowable and predetermined for a selected formation. In one embodiment, each valve 78 is actuated five times in series before the subsequent valve 78 is actuated the same number of times. In one embodiment, there may be a period of time during which none of the valves 78 are actuated after all valves 78 in the cleaning apparatus 68 have been actuated: a predetermined number of times, wherein the predetermined number of times includes a single actuation. Alternatively, the sequence of valve actuations may continue throughout the operation of the separator 10.

In operation, material M, which typically consists of solid matter and free liquid falls by gravity through the inlet assembly 24 onto plate 30. The material is flung off the plate 30 by its centrifugal like throwing force and impacts the screen 48. The solid material falls between the screen assembly 46 and the flight assembly 32. As the solid material falls, by gravity, down the flights 36, the free liquid is slung outwardly, by impacting centrifugal or revolving force, through the openings in the screen 48, and strikes the inside of the housing 18. The liquid cascades down the housing wall and flows out through the opening 0 between the housing 18 and the baffle 42. Meantime, the remaining material falls off the bottom of the flight assembly 32 to the bottom of the housing 18. In one embodiment, a conveyor belt (not shown) or other collection mechanism, is located at the base of the housing below the separator to collect the now separated material and move it to the next station. In another embodiment, the separated material is shunted overboard.

Material exiting through the solids outlet assembly 54 below the baffle assembly 40 typically maintains momentum outward and in the direction of the rotation of the flight and screen assemblies 32, 46. Thus, some of the solid material tends to hit one side of the spokes 60 and the outer wall 56 as it is being discharged and accumulates there. Material also accumulates on the center hub 58 and shield 66. One or more pulse nozzles 70 in each discharge section 62 are actuated to provide bursts of air directed toward the interior of each discharge section 62. The air burst knocks material off of the spokes 60 and walls 56, 58 near each pulse nozzle 70. In one embodiment, a controller 74 is programmed to actuate and de-actuate one or more valves in fluid communication with the air source 72 and with the pulse nozzles 70. Air is flowed from an air source 72 to the valve 78. In one embodiment, air is accumulated in the accumulator 86 to a predetermined pressure and the accumulator 86 is in fluid communication with the valve 78. The valve 78 is actuated to communicate air to corresponding pulse nozzles 70 coupled to the solids outlet assembly 54 and de-actuated to cease communicating air to the corresponding pulse nozzles 70. In one embodiment, air is flowed to a plurality of valves 78 in sequence. In one embodiment, air is pulsed to each valve 78 a predetermined number of times before air is flowed to a subsequent valve 78 in sequence. As each pulse nozzle 70 is actuated, accumulated material in the vicinity of the nozzle 70 is blown toward the interior of the discharge section 62 and falls to the conveyor or collection area below.

It is appreciated that by keeping the solids outlet assembly 54 relatively free from accumulated material, the efficiency of the separator 10 is improved in various aspects. In one aspect, the separator 10 does not have to be taken off line or stopped to perform cleaning maintenance as frequently as a separator without a cleaning apparatus 68. In another aspect, by keeping the solids outlet assembly 54 relatively clean and ejecting more solid material, the volume of material that can be treated by the separator 10 during a period of time is improved. Finally in keeping material discard flowing and preventing material build up around the screen section allows the efficiency of the screens to be maximized and perform at a steady state. This ensures the dryness of the discard also achieves and holds a steady state value.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

The invention claimed is:

1. An apparatus for drying material comprising:

an outer housing having a top portion with a material inlet therethrough;

a drive assembly including a rotatable drive shaft within the outer housing;

a flight assembly coupled to the drive shaft and rotatably driven thereby;

a screen assembly coupled to the drive assembly and rotatably driven thereby and including a perforated screen located radially outwardly from the flight assembly;

wherein material fed through the material inlet is centrifugally directed between the flight assembly and the screen assembly;

wherein the screen assembly separates a fluid component of the material from a solid component;

a solids outlet assembly coupled to the outer housing that receives and discharges the solid component;

wherein the solids outlet assembly has at least one wall surface upon which the solid component accumulates to form an accumulated solid adhering thereto; and a cleaning apparatus coupled to the solids outlet assembly and comprising:

a plurality of pulse nozzles adapted to discharge air and positioned relative to the at least one wall surface of the solids outlet assembly such that air discharged from each of the nozzles dislodges and removes the accumulated solid from the wall surface;

an air source selectively in fluid communication with each pulse nozzle;

a controller that controls a flow of air from the air source by providing a periodic flow of air to the plurality of nozzles; and wherein each nozzle is actuated by the periodic flow of air and delivers a corresponding periodic burst of air to the at least one wall surface of the solids outlet assembly.

2. The apparatus of claim 1 wherein the solids outlet assembly further comprises:

an inspection door through the outer wall selectively openable to provide access to the solids outlet assembly; and the cleaning apparatus further comprises a pulse nozzle coupled to the inspection door and in selective fluid communication with the air source, the nozzle operable to remove accumulated solid material from the surface of the inspection door.

3. The apparatus of claim 1, wherein the solids outlet assembly includes a circumferential outer wall, a center hub, and a plurality of spokes extending between the central hub and the outer wall to define a plurality of sections, and wherein a plurality of nozzles are located within each section of the solids outlet assembly.

4. The apparatus of claim 3 wherein the cleaning apparatus further comprises:

a nozzle manifold selectively in fluid communication With the air source for distributing air to the plurality of nozzles in a corresponding section of the solids outlet assembly.

5. The apparatus of claim 3 wherein the cleaning apparatus further comprises:

a valve manifold having a plurality of valves in fluid communication with the air source;

at least one nozzle manifold, selectively in fluid communication with a corresponding valve, that distributes air to the plurality of nozzles within a corresponding section of the solids outlet assembly;

wherein the controller transmits a signal to individually actuate each valve in sequence so that air is supplied through a corresponding nozzle manifold to the plurality of nozzles within a corresponding section of the solids outlet assembly thereby simultaneously actuating the plurality of nozzles within the section to remove accumulated solid material therein.

6. The apparatus of claim 5, wherein each valve is actuated a predetermined number of times in series before the subsequent valve is actuated.

7. The apparatus of claim 6, wherein each valve is cycled such that the valve is actuated for a first predetermined amount of time and non-actuated for a second predetermined amount of time, thereby providing bursts of air to the plurality of nozzles corresponding to the valve being cycled.

8. The apparatus of claim 5 wherein the cleaning apparatus further comprises:

an air accumulator in fluid communication with the air source, the air accumulator providing sufficient air volume and back pressure to the valve manifold to actuate the plurality of nozzles within the corresponding section of the solids outlet assembly when the corresponding valve is actuated.

9. The apparatus of claim 1, wherein the air source is rig air or a compressor.

10. A cleaning apparatus for a material dryer, wherein the material dryer comprises an outer housing having a top portion with a material inlet therethrough, a screen assembly rotatably retained within the housing, a flight assembly rotatably concentrically retained within the screen assembly, a drive assembly for rotating the screen assembly and the flight assembly, and a solids outlet assembly that receives and discharges a solid material, the solids outlet assembly having a plurality of sections defined therethrough, wherein the solid material accumulates upon at least one surface of the solids outlet assembly to form an accumulated solid adhering thereto, the cleaning apparatus comprising:

an air source;

a pulse nozzle selectively in fluid communication with the air source and located within a section of the solids outlet assembly, wherein the pulse nozzle is adapted to discharge air and is positioned relative to the at least one surface of the solids outlet assembly such that air discharged from the nozzle dislodges and removes the accumulated solid from the surface;

a controller that controls an air flow from the air source by providing a periodic flow of air to the pulse nozzle;

wherein the nozzle is actuated by the periodic air flow to provide a corresponding periodic burst of air to the at least one surface of the solids outlet assembly, the burst of air of sufficient force to dislodge the accumulated solid within the section.

11. The apparatus of claim 10, further comprising:

a plurality of nozzles located within a corresponding section of the solids outlet assembly.

12. The apparatus of claim 11, further comprising:

a nozzle manifold selectively in fluid communication with the air source for distributing air to the plurality of nozzles in the corresponding section of the solids outlet assembly.

13. The apparatus of claim 11, further comprising:

a valve manifold having a plurality of valves in fluid communication with the air source;

at least one nozzle manifold, selectively in fluid communication with a corresponding valve, that distributes air to the plurality of nozzles within the corresponding section of the solids outlet assembly;

wherein the controller transmits a signal to individually actuate each valve in sequence so that air is supplied through a corresponding nozzle manifold to the plurality of nozzles within the corresponding section of the solids outlet assembly thereby simultaneously actuating the plurality of nozzles within the section to dislodge and remove the accumulated solid material from a surface therein.

14. The apparatus of claim 13, wherein each valve is actuated a predetermined number of times in series before the subsequent valve is actuated.

15. The apparatus of claim 14, wherein each valve is cycled such that the valve is actuated for a first predetermined amount of time and non-actuated for a second predetermined amount of time, thereby providing bursts of air to the plurality of nozzles corresponding to the valve being cycled.

16. The apparatus of claim 13, further comprising:

an air accumulator in fluid communication with the air source, the air accumulator providing sufficient air volume and back pressure to the valve manifold sufficient to actuate the plurality of nozzles within the corresponding section of the solids outlet assembly when the corresponding valve is actuated.

17. The apparatus of claim 10, wherein the air source is rig air or a compressor.

* * * * *